US007052273B2

(12) United States Patent
Sehmbi

(10) Patent No.: US 7,052,273 B2
(45) Date of Patent: May 30, 2006

(54) PREMIXED FUEL BURNER ASSEMBLY

(75) Inventor: Jaswinder S. Sehmbi, Caledon East (CA)

(73) Assignee: Millomat Stampings Inc., Brampton (CA)

( * ) Notice: Subject to any disclaimer, the term of this patent is extended or adjusted under 35 U.S.C. 154(b) by 162 days.

(21) Appl. No.: 10/764,570

(22) Filed: Jan. 27, 2004

(65) Prior Publication Data

US 2005/0048429 A1 Mar. 3, 2005

Related U.S. Application Data

(60) Provisional application No. 60/442,514, filed on Jan. 27, 2003.

(51) Int. Cl.
*F23D 14/62* (2006.01)

(52) U.S. Cl. ..... 431/354; 431/328; 239/553.3

(58) Field of Classification Search ..... 431/354, 431/328, 329; 239/553.3
See application file for complete search history.

(56) References Cited

U.S. PATENT DOCUMENTS 3,156,292 A * 11/1964 Ross ..... 239/419.5
4,118,175 A * 10/1978 Riehl ..... 431/354
5,520,536 A 5/1996 Rodgers et al.
5,743,727 A * 4/1998 Rodgers ..... 431/328
5,915,954 A 6/1999 Rodgers
6,000,934 A 12/1999 Shavers et al.
6,139,312 A 10/2000 Lasagni
6,371,753 B1 * 4/2002 O'Donnell et al. ..... 431/125
6,461,152 B1 10/2002 Wood et al.

* cited by examiner

*Primary Examiner*—Alfred Basichas
(74) *Attorney, Agent, or Firm*—Bereskin & Parr; Isis E. Caulder

(57) ABSTRACT

A premixed fuel burner assembly includes a hollow tubular burner body, a hollow tubular venturi tube and a distribution plate. The burner body is a hollow tube having a open end and a closed end. The burner body also has a longitudinal porting area within which are formed a plurality of radially formed slots. The hollow tubular venturi tube is positioned within the burner body along the longitudinal axis extending from said first end. The distribution plate has a mid-section and longitudinal flanges. The flanges of the distribution plate are coupled to the inside surface of burner body and said mid-section has a plurality of holes formed within. The distribution plate is axially aligned and positioned within said burner body such that said holes of distribution plate are positioned adjacent the radially formed slots within said burner body.

12 Claims, 4 Drawing Sheets

PREMIXED FUEL BURNER ASSEMBLY

This application claims the benefit under 35 U.S.C. 119(e) of U.S. Provisional Application No. 60/442,514, filed Jan. 27, 2003.

FIELD OF THE INVENTION

This invention relates to fuel burner equipment and more particularly to a premixed fuel burner assembly.

BACKGROUND OF THE INVENTION

Premixed fuel burner assemblies are used with various heating equipment such as boilers, commercial hot water headers, fuel barbeques, and the like. Fuel burners are devices into which a flow of combustible fuel (usually gas) is introduced into a mixing chamber, where it is mixed with air supplied in a suitable proportion to the combustible gas. After mixing, the mixture of combustible fuel and air exits the mixing chamber through burner ports where it is ignited and burnt.

Specifically, a typical premixed fuel burner assembly consists of a hollow burner body having a closed end and an open end into which the premixed fuel/air flows. The burner body includes a porting area that consists of burner flame port perforations (i.e. slots and/or holes). Within the burner body is a venturi tube that typically contains a multiplicity of holes through and out which the fuel and air mixture from the interior of the body flows. Fuel and air are both provided into the boiler body through the venturi tube. Specifically, fuel is provided into the venturi tube through a fuel nozzle and air is provided around the fuel nozzle. Fuel and gas are mixed to produce a combustible mixture which subsequently is passed through the burner body and ignited to produce a burner flame that, in the case of a water heater is applied to a heat exchanger of the boiler.

Conventional premixed fuel burner assemblies produce short flames that are just beyond or above the burner porting area. Normally the mixture has 30 percent excess air so as to provide cleaner combustion products. At loadings (i.e. heat per unit area) below approximately 6 kilowatts per square decimeter, the burner port surface will be radiant since the velocity of the mixture is low resulting in the flame being positioned on or closely adjacent to the surface. This gives rise to problems of thermal fatigue and high temperature oxidation of the burner porting surface, and potential flashback of the flame into the burner body. At higher loadings (e.g. 12 kilowatts per square decimeter and above) the increase in volumetric flow is such that the velocity of the mixture may be increased to the point where the flame front is further from the burner porting surface resulting in a relatively cool porting surface. However, at high loadings if the amount of excess air is not or cannot be controlled, overheating of burner porting surface can still result when there is inadequate excess air (i.e. when there is too much fuel in the air/fuel mixture) since in such a case the flame will sit on the surface of the burner increasing the temperature. As is conventionally known, when the burner body becomes too hot (e.g. 2000 degrees Celcius) the fuel burner assembly can suffer failures, melting and irreversible damage.

Various types of fuel burner assemblies have been developed to attempt to maintain the flames above the surface of the outer cylinder by operating at high loadings (i.e. high fuel/air velocities) while at the same time maintaining a proper mix of fuel and flame stability. For example, U.S. Pat. No. 6,461,152 to Wood et al. discloses a tubular burner consisting of a cylindrical tubular body into which a distributor component can be fitted. The distributor is substantially the same axial length as the tubular burner body but of a smaller cross-sectional dimension than said body so to allow for easy insertion. The distributor divides the burner body into an upper and a lower chamber. The distributor has a first tubular portion and a second extension portion each of which is provided with axially aligned flanges having a number of perforations. While this assembly achieves a reasonable distribution of air and fuel streams prior to delivering the fuel/air mixture to the porting area of the tubular burner, the construction and assembly of this burner is expensive, as is the manufacture of the various components involved in the construction.

SUMMARY OF THE INVENTION

The invention provides in one aspect, a premixed fuel burner assembly, comprising:

(a) a hollow tubular burner body having a longitudinal axis, said burner body having a longitudinal porting area having formed within a plurality of radially formed slots, said burner body having a first end and a second end:

(b) a hollow tubular venturi tube positioned within said burner body along said longitudinal axis extending from said first end;

(c) a distribution plate having a mid-section and longitudinal flanges, said flanges being coupled to the inside surface of burner body, said mid-section having a plurality of holes formed within, and said distribution plate being positioned within said burner body such that the holes of distribution plate are positioned adjacent to the radially formed slots within said burner body.

The invention provides in another aspect, a method of making a fuel burner assembly, said method comprising the steps:

(a) forming a tubular burner body;

(b) cutting a plurality of radial slots formed within said tubular body;

(c) forming a hollow tubular venturi tube and positioning it within aid burner body along said longitudinal axis extending from said first end;

(d) forming a distribution plate with a mid-section and longitudinal flanges;

(e) cutting a plurality of holes within the mid-section; and (f) coupling the flanges of the distribution plate to the inside surface of burner body such that the distribution plate is positioned between the inside surface of the burner body and the venturi tube and such that the holes within the mid-section are positioned adjacent the slots of said burner body.

Further aspects and advantages of the invention will appear from the following description taken together with the accompanying drawings.

DETAILED DESCRIPTION OF THE INVENTION

Figure 1:
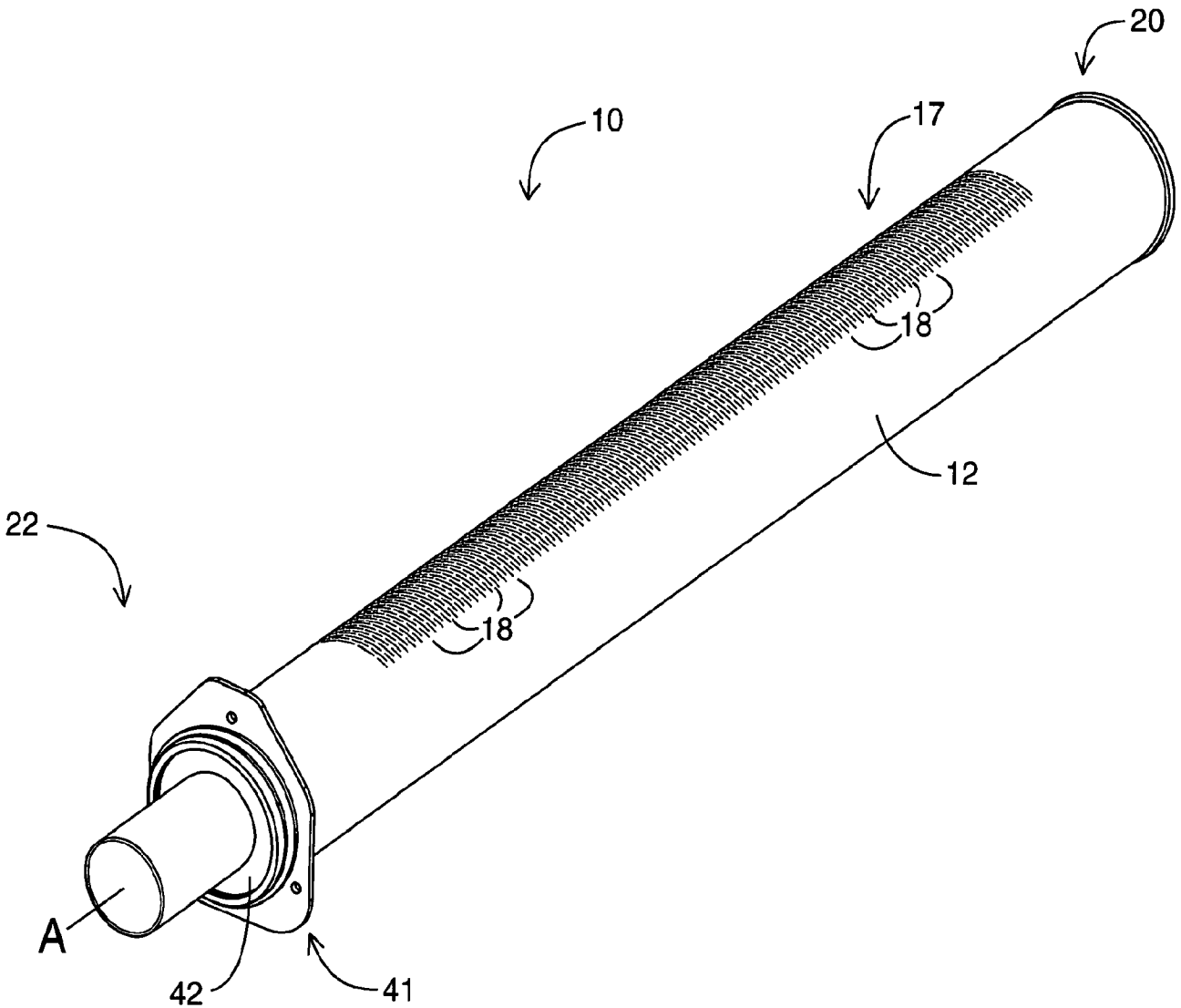
FIG. 1 is a side perspective view of the premixed fuel burner assembly of the present invention.
Figure 2:
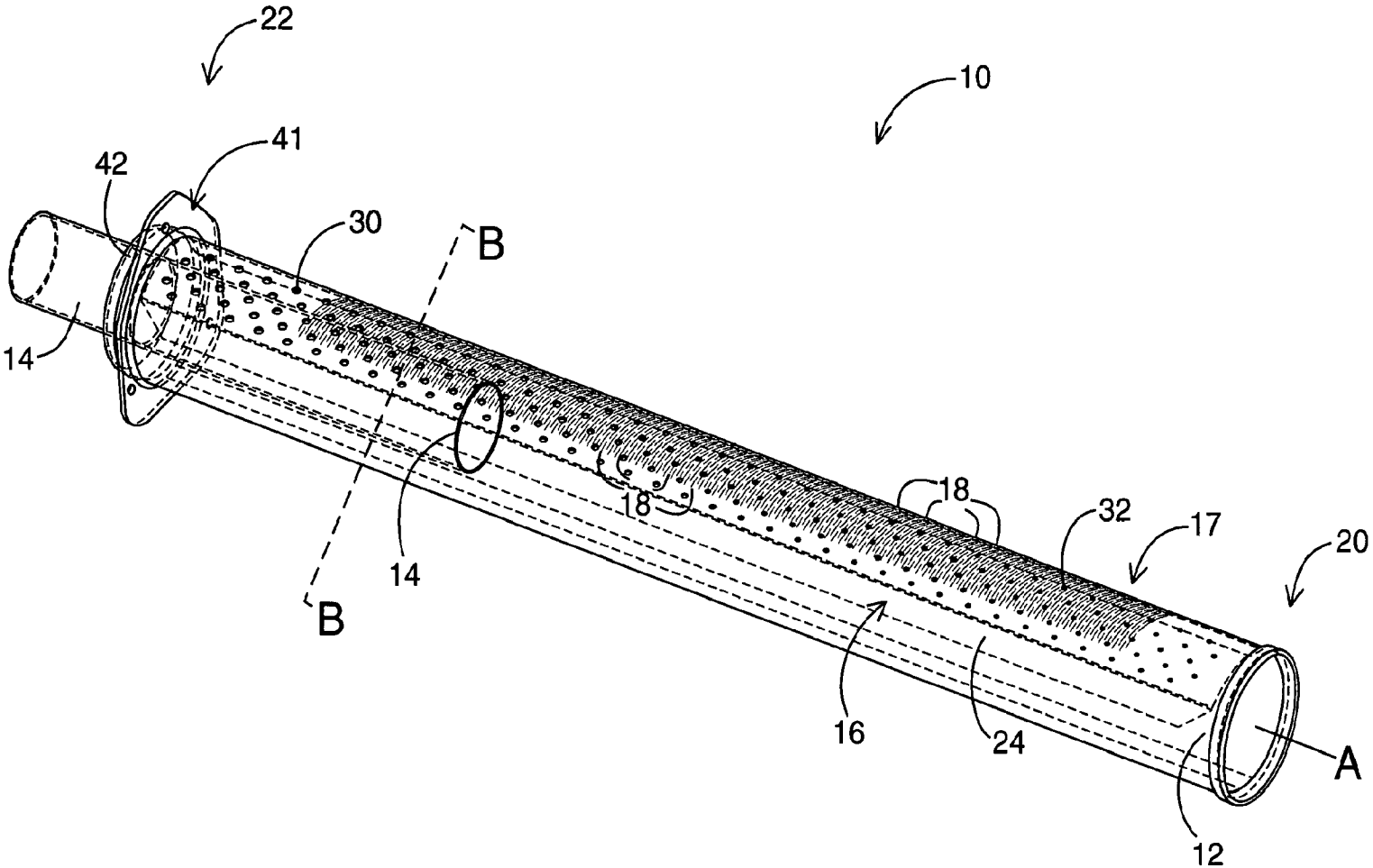
FIG. 2 is a side perspective view of the premixed fuel burner assembly of the present invention with internal components of the premixed fuel burner assembly being shown in dotted outline.
Figure 3:
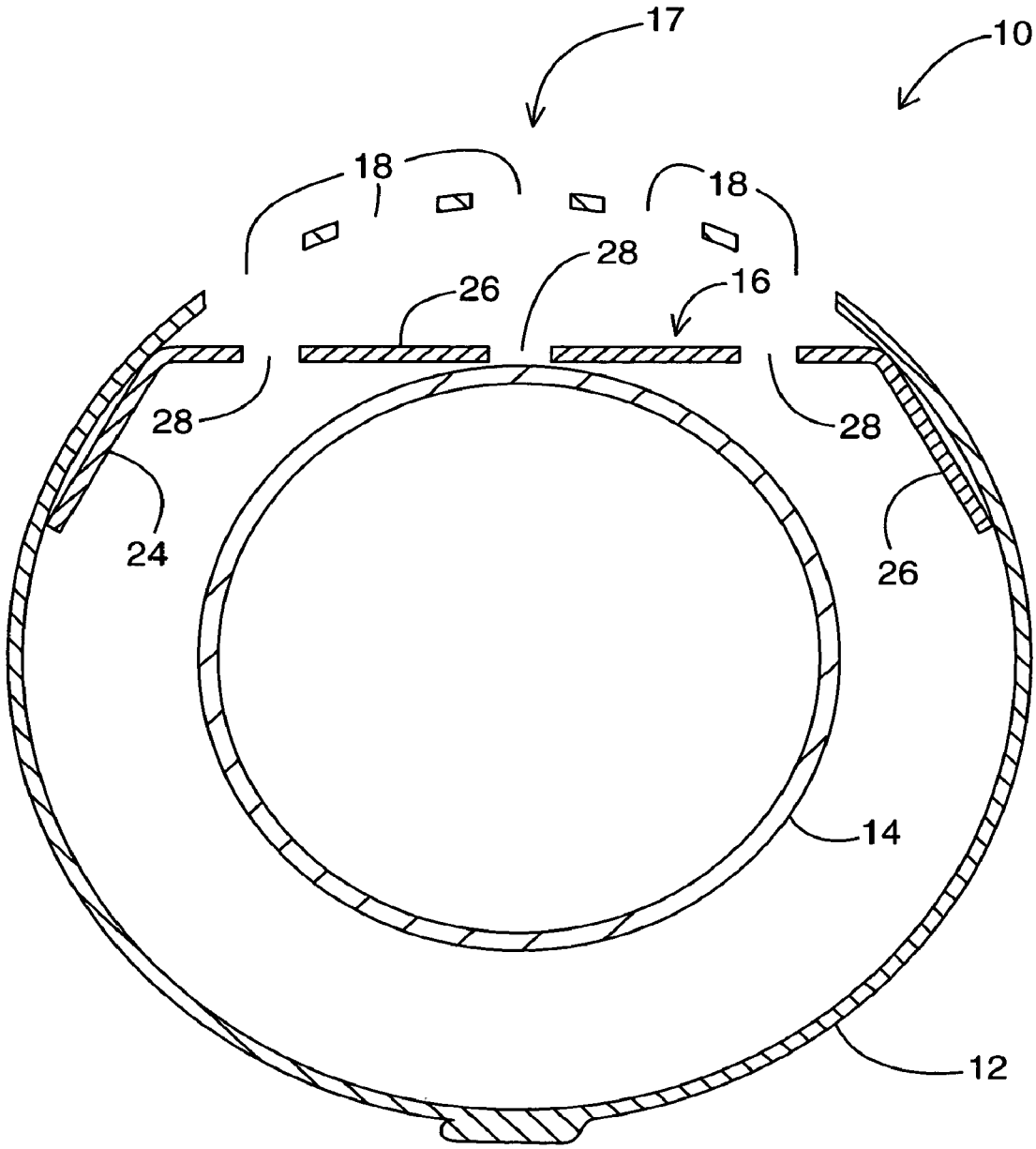
FIG. 3 is an radial cross-sectional view of the premixed fuel burner assembly of FIG. 2 taken along line B–B' of FIG. 2.

Referring to FIGS. 1, 2 and 3, illustrated therein is a premixed fuel burner assembly 10 made in accordance with a preferred embodiment of the present invention. Fuel burner assembly 10 consists of a burner body 12, a conventional fuel/air mixing venturi tube 14 (FIGS. 2 and 3), and a distribution plate 16. Venturi tube 14 and distribution plate 16 are positioned within burner body 12 and together ensure good mixing of the fuel and air as the fuel/air mixture is urged through burner body 12 and an even and raised flame profile on the porting area of burner body 12 to minimize thermal fatigue and oxidation effects on burner body 12. Additionally, since fuel burner assembly 10 generates a high velocity of a well mixed fuel/air stream throughout the fuel burner assembly 10 such that excess air is evenly provided throughout the mixture, flame flashback and instability effects are inhibited.

Burner body 12 is a hollow cylindrical tube having preferably having a circular cross-section. However, it should be understood that burner body 12 could also have various shaped cross-sections (e.g. oval, rectangular, polygon, etc.) depending on the particular use of burner body 12. For example, in the case where burner body 12 has an oval cross-section, the height of the combustion chamber can be minimized by orienting the minor axis in the vertical direction. Burner body 12 has a longitudinal axis A and is axially aligned with venturi tube 14 and distribution plate 16 as will be described. Burner body 12 is closed at one end 20 and open at the other end 22. The closed end 20 and open end 22 are formed using conventionally known crimping techniques. The open end 22 is adapted to receive and mount one end of venturi tube 14 and distribution plate 16 as will be described. The closed end of burner body 12 is closed so that burning is confined within burner body 12. It should be understood that burner body 12 may be manufactured out of any high temperature resistant metal (e.g. stainless steel, aluminized steel, coated steel, etc.) Finally, burner body 12 should be understood to be any burner having an outer surface that defines an internal cavity in which venturi tube 14 and distribution plate 16 can be disposed.

As shown, the surface of burner body 12 includes a porting area 17 within which are formed a plurality of burner ports 18. Burner ports 18 consist of a plurality of small radially oriented rectangular slots arranged in an offset manner as shown. Burner ports 18 keep the flame front 50 (FIG. 4) off of the surface of the deck while maintaining a stable flame which results in the surface of the burner body 12, and in particular, the porting area 17 being maintained at a relatively low temperature. Burner ports 18 are of an appropriate size for a particular application. For example, if fuel burner assembly is to be used within a hot water heater, burner ports 18 may be approximately 6 mm by 0.75 mm. Due to the equal configuration of burner ports 18 as well as the even distribution of mixed fuel/air above distribution plate 16 as will be discussed, an equal flame 60 height along the entire porting area 17 is provided (see FIG. 4).

Referring to FIGS. 2 and 3, venturi tube 14 is a hollow cylindrical tube having either a circular or oval cross-section. It should be understood that venturi tube 14 may be manufactured out of any high temperature resistant metal (e.g. stainless steel, aluminized steel, coated steel, etc.) Venturi tube 14 is axially aligned with the longitudinal axis of burner body 12 and positioned within burner body 12 along a short longitudinal section of burner body 12 from the open end 22 into the area within burner body 12. The remainder of venturi tube 14 extends out of the open end 22 of burner body 12 and out of the combustion chamber and being attached to and spaced from a gas injection member (not shown) connected to a source of gas (e.g. natural gas outside of the water header).

The exterior surface of venturi tube 1 4 where it enters the combustion chamber is sealed using an end cap 42. Flange 41 (FIGS. 1 and 2) is adapted to be fastened to an appliance in which fuel burner assembly 10 is used. End cap 42 is preferably formed using beeding and crimping methods to eliminate the necessity of welding, although welding can also be utilized. Accordingly, air is only provided through the venturi tube 14. Preferably, three spacers (not shown) are used to maintain a centered longitudinal position for venturi tube 14. A mixture of fuel and air is provided to venturi tube 14 through a fuel nozzle (not shown). The length and diameter of venturi tube 14 are selected to provide for proper mixing of fuel with air. Specifically, venturi tube 14 is sized so that more air than is required for combustion is provided (e.g. 30%) to reduce the maximum flame temperature and to provide cleaner combustion products (i.e. lower levels of toxic $NO_x$ and carbon monoxide emissions) such that a high velocity of air/fuel mixture is provided to the area within burner body 12 underneath the porting area 17 of burner body 12.

Referring to FIGS. 2 and 3, distribution plate 16 is a long plate having a C-shaped cross-section. Distribution plate 16 is adapted to axially aligned with the longitudinal axis of burner body 12 and to fit within minor section of burner body 12 directly underneath longitudinal porting area 17 It should be understood that distribution plate 16 may be manufactured out of any high temperature resistant metal (e.g stainless steel, aluminized steel, coated steel, etc.) Distribution plate 16 has two longitudinal folded flanges 24 and 26 and a mid-section 26. A plurality of evenly spaced holes 28 is formed within the surface of mid-section 26. Longitudinal folded flanges 24 and 26 (FIG. 3) are shaped to contact the inside surface of burner body 12 along its longitudinal length as shown.

The exterior surface of flanges 24 and 26 of distribution plate 16 are coupled to the inside surface of burner body 12 using an appropriate conventionally known welding technique (e.g. spot welding or seem welding techniques). Flanges 24 and 26 are coupled to the inside surface of burner body 12 such that that the mid-section 26 of distribution plate 16 is positioned underneath the longitudinal porting area 17 of burner body. Specifically, distribution plate 16 is positioned within burner body 12 such that the plane defined by the holes 28 within mid-section 26 of distribution plate is oriented along and collinear with the longitudinal axis of burner body 12 and such that holes 28 are positioned adjacent the burner ports 18 within porting area 17.

Holes 28 on distribution plate 16 are of variable size. The size of each hole 28 varies according to its position on distribution plate 16. Specifically, holes 28 are largest at one end of distribution plate 16 and smallest at the other end. The end at which holes 28 are the largest is intended to be located at the open end of fuel burner assembly 10 and the end at which holes 28 are smallest is intended to be located at the closed end 20 of fuel burner assembly 10. Preferably, holes 28 are one of two sizes, where larger sized holes 30 clustered at the open end 22 and a small sized holes 32 which extend the length from the end of the cluster of the larger sized holes 31 until the closed end 20. It should be understood that while only two sizes of holes area shown and described, any form of gradient of hole size is contemplated. Specifically, in between the ends of distribution plate 16, holes 28 can be gradually reduced in size as they traverse from the open end 22 of fuel burner assembly 10 to the closed end of fuel burner assembly 10. Further, various patterns or configurations of holes 28 are also contemplated depending on the particular functionality required by a particular application.

Figure 4:
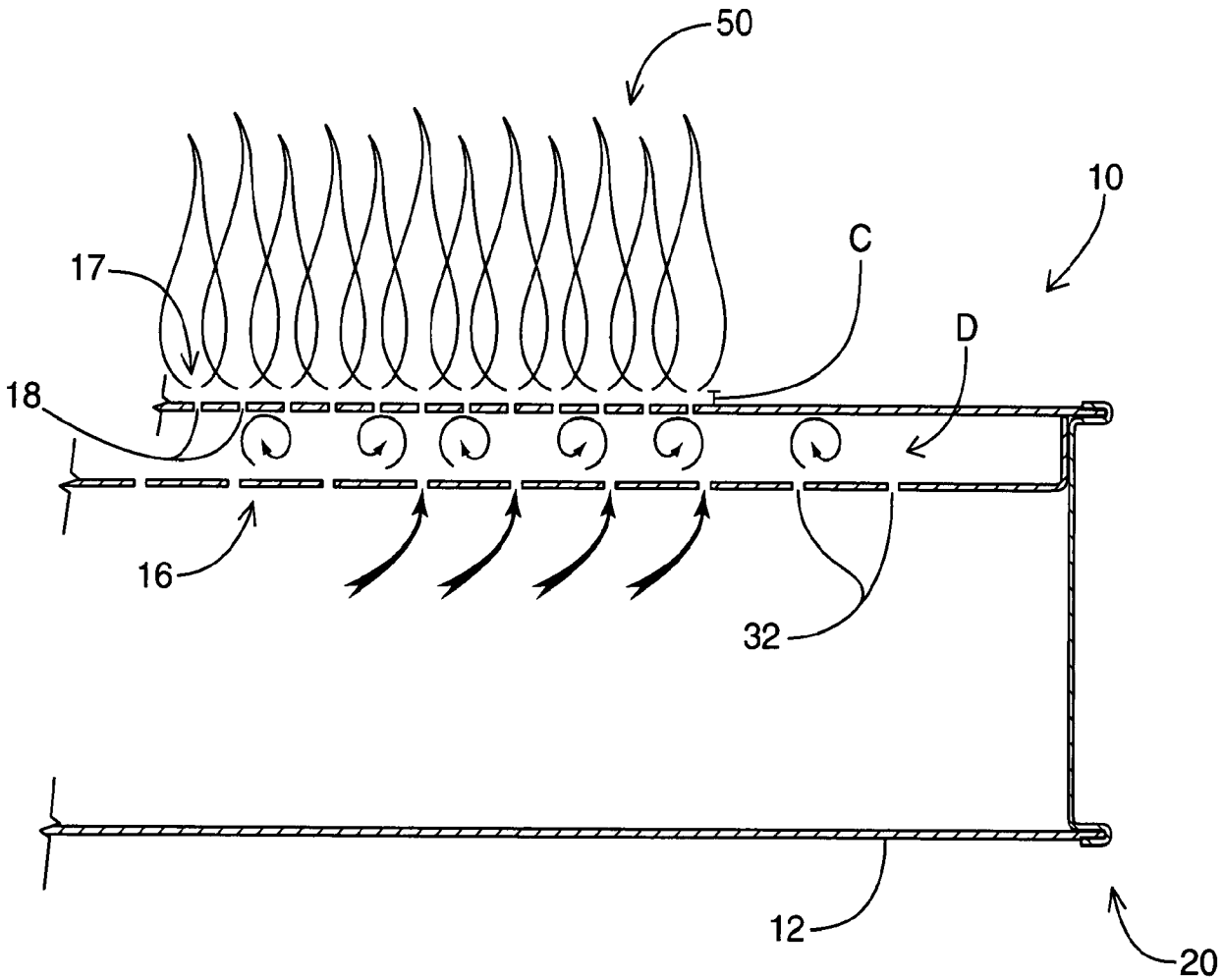
FIG. 4 is a longitudinal cross-sectional view of the pre-mixed fuel burner assembly in use illustrating the position of flames in respect of the burner body.

The holes 28 within distribution plate 16 allow for improved mixing of fuel and air between the distribution plate 16 and the inside surface of burner body 12 (i.e. "mixing chamber D" as shown in FIG. 4). The presence of larger holes at the closed end 20 and smaller holes at the open end 22, provides for a higher degree of turbulence at the open end 22 of burner tube 12 and a lower degree of turbulence at the closed end 20. Since fuel and air streams are being discharged at the open end 22, increased amount of turbulence is needed at the open end 22 By directing an increased amount of turbulence to the open end 22 part of fuel burner assembly 10, an improved efficiency in mixing of fuel and air streams can be achieved. In prior art fuel burner assemblies, turbulence is provided evenly at both open and closed ends of the burner assembly, resulting in unnecessary turbulence at the closed end and not enough turbulence at the open end for optimal fuel and air mixing. Accordingly, the specific arrangement of holes 28 within distribution plate 16 in conjunction with the shorted extent of venturi tube 14 together produce a substantially evenly distributed mixture of air and fuel within mixing chamber D and accordingly even and highly set flames 5 above porting area of burner body 12. Further, this is provided without a high pressure drop.

FIG. 4 is a cross-sectional view of fuel burner assembly 10 illustrating how flames 50 sit above the porting surface 17 of burner body 12 at a distance represented by "C". This is the case due to the improved mixing capability of fuel burner assembly 10 and accordingly it's ability to maintain flame stability at high fuel/air mixture velocities (i.e. high loading). Specifically, the volume defined by between the top surface of distribution plate 16 and inside surface of burner body 16 constitutes a mixing chamber D which receives a mixed air/fuel stream through holes 28 in mid-section of distribution plate 16 and which redistributes the mixed air/fuel stream through burner ports 18 in burner body 12. The mixing chamber constitutes a volume that is semi-circular in cross-section and which runs the entire length of burner body 12 The holes 28 within (smaller holes 32 are shown in FIG. 4 since the closed end 20 section of fuel burner assembly 10 is shown) distribution plate 16 allow for improved mixing of fuel and air within the mixing chamber D. Further, by using larger holes at the closed end 20 and smaller holes at the open end 22, increased turbulence is produced at the open end 22 of burner tube 12 as compared to the closed end 20. Accordingly, flame flashback is prevented since distribution plate 1 6 physically prevents fuel from coming back to venturi tube 14.

Accordingly, fuel burner assembly 10 is designed to maintain flames above the surface of burner body 12 by operating at high loadings (i.e. high fuel/air velocities) while at the same time maintaining a proper mix of fuel and flame stability. Fuel burner assembly 10 achieves these features through the use of a particularly perforated distribution plate 16 (i.e. variable sized holes 28) as discussed in conjunction with a partially extending venturi tube to optimize the mixing process between fuel and air streams.

As will be apparent to persons skilled in the art, various modifications and adaptations of the structure described above are possible without departure from the present invention, the scope of which is defined in the appended claims.

What is claimed is:

1. A pre-mixed fuel burner assembly, comprising:

(a) a hollow tubular burner body having a longitudinal axis, said burner body having a longitudinal porting area having formed within a plurality of radially formed slots, said burner body having an open end and a closed end;

(b) a hollow tubular venturi tube positioned within said burner body along said longitudinal axis extending from said open end;

(c) a distribution plate having longitudinal mid-section and flanges, said flanges being coupled to the inside surface of the burner body, said mid-section having a plurality of holes formed within, and said distribution plate being positioned within said burner body such that the holes of distribution plate are positioned adjacent to the radially formed slots within said burner body and extending from said open end to said closed end of the burner body.

2. The fuel burner assembly of claim 1, wherein the holes of the distribution plate are of variable size.

3. The fuel burner assembly of claim 1, wherein the holes of the distribution plate are larger at the open end and smaller at the closed end.

4. The fuel burner assembly of claim 1, wherein said holes of the distribution plate are circular.

5. The fuel burner assembly of claim 1, wherein said venturi tube extends a length from said open end that is substantially shorter than the length of said distribution plate.

6. The fuel burner assembly of claim 1, wherein said porting slots are rectangular.

7. A method of making a fuel burner assembly, said method comprising the steps:

(a) forming a tubular burner body having an open end and a closed end;

(b) cutting a plurality of radial slots formed within said tubular body;

(c) forming a hollow tubular venturi tube and positioning venturi tube within said burner body along said longitudinal axis extending from said open end partially into said burner body;

(d) forming a distribution plate with longitudinal mid-section and flanges;

(e) cutting a plurality of holes within the mid-section; and (f) coupling the flanges of the distribution plate to the inside surface of the burner body such that the distribution plate is positioned between the inside surface of the burner body and the venturi tube and such that the holes within the mid-section are positioned adjacent the slots of said burner body.

8. The method of claim 7, wherein the length of said venturi tube extends for only a portion of the entire length of the burner body.

9. The method of claim 7, wherein the length of said distribution plate extends the entire length of the burner body.

10. The method of claim 7, wherein step (e) comprises cutting holes within the distribution plate of variable size.

11. The method of claim 7, wherein the holes within the distribution plate are larger at a first end and smaller at a second end.

12. The method of claim 7, wherein the porting slots are cut to be rectangular.

* * * * *

UNITED STATES PATENT AND TRADEMARK OFFICE

CERTIFICATE OF CORRECTION

PATENT NO. : 7,052,273 B2
APPLICATION NO. : 10/764570
DATED : May 30, 2006
INVENTOR(S) : Jaswinder S. Sehmbi It is certified that error appears in the above-identified patent and that said Letters Patent is hereby corrected as shown below:

Claim 7, column 6, line 41, replace -- positioning venturi tube -- with "positioning the venturi tube"

Signed and Sealed this

Fifth Day of September, 2006

JON W. DUDAS
*Director of the United States Patent and Trademark Office*